US006148812A

United States Patent [19]

Taplan et al.

[11] Patent Number: 6,148,812

[45] **Date of Patent: *Nov. 21, 2000**

[54] COOKING UNIT, SUCH AS A STOVE, FOR COOKING FOOD

[75] Inventors: Martin Taplan, Rheinböllen; Herwig Scheidler, Mainz; Christof Köster, Müllheim an der Ruhr, all of Germany

[73] Assignee: Schott Glas, Mainz, Germany

[ * ] Notice: This patent is subject to a terminal disclaimer.

[21] Appl. No.: 09/460,063

[22] Filed: Dec. 14, 1999

Related U.S. Application Data

[63] Continuation of application No. 09/022,466, Feb. 12, 1998, Pat. No. 6,021,774.

[30] Foreign Application Priority Data

Feb. 14, 1997 [DE] Germany ..... 197 05 715

[51] Int. Cl.[7] ..... F24C 15/10

[52] U.S. Cl. ..... 126/39 J; 126/218

[58] Field of Search ..... 126/39 BA, 39 J, 126/39 H, 211, 218, 39 D, 39 F

[56] References Cited

U.S. PATENT DOCUMENTS

| | | | |
|---|---|---|---|
| 2,798,930 | 7/1957 | Frost | 126/39 BA |
| 3,830,216 | 8/1974 | Dodd | 126/39 J |
| 4,313,416 | 2/1982 | Lau | 126/39 BA |
| 5,036,831 | 8/1991 | Ray | 126/211 |
| 5,402,767 | 4/1995 | Kahlke | 126/39 J |

*Primary Examiner*—Ira S. Lazarus
*Assistant Examiner*—Sara Clarke
*Attorney, Agent, or Firm*—Niles H. Ljungman & Associates

[57] ABSTRACT

Unit with at least one plate made of a material, which material is permeable to thermal radiation, such as glass ceramic, glass, ceramic or a similar material, as a surface for cooking, frying and/or keeping warm. The unit with at least one plate is on a frame construction with different types of adjustable heat sources distributed underneath and on the plate. Some of the heat sources are distributed under the plate in the form of radiant burners and act indirectly by radiation through the plate. Other heat sources are located above the level of the plate in the form of open atmospheric or atmospheric pressure gas burners and transmit heat directly by producing open flames. The respective heat sources correspond to the cooking, frying and/or warming positions. Whereby, the at least one height-equalizing, plate-shaped, modular top part, which top part sits on a portion of the frame on which the plate lies, can be securely fastened to the frame of the unit, and also has heat sources distributed under its plate and acting indirectly by radiation through the plate, permits all the cooking, frying and/or warming positions to lie in a plane of equal height. The plane of equal height is defined by the height of the open, atmospheric gas burners located above the level of the plate or by their corresponding pot grates. The plates form two planes parallel to one another and the height of which plates is different.

18 Claims, 3 Drawing Sheets

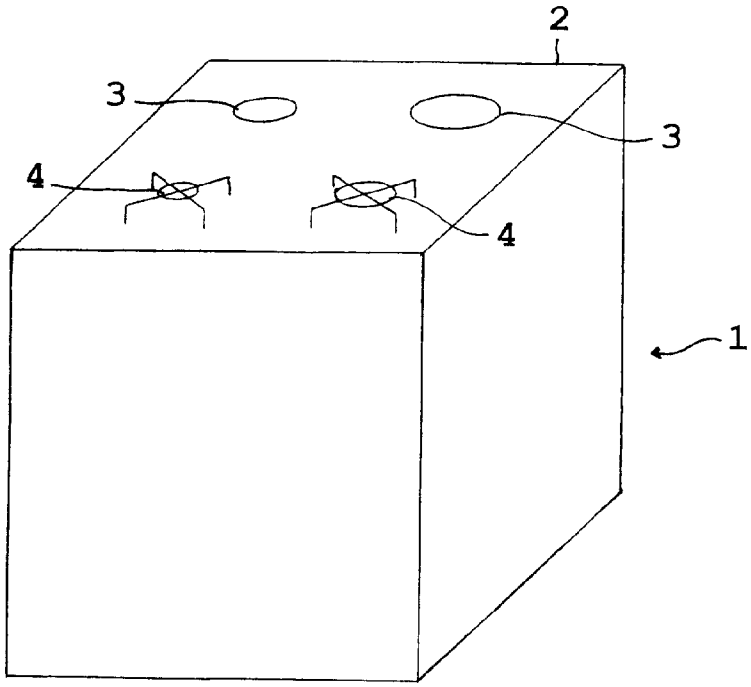
FIG. 1
PRIOR ART
FIG. 2
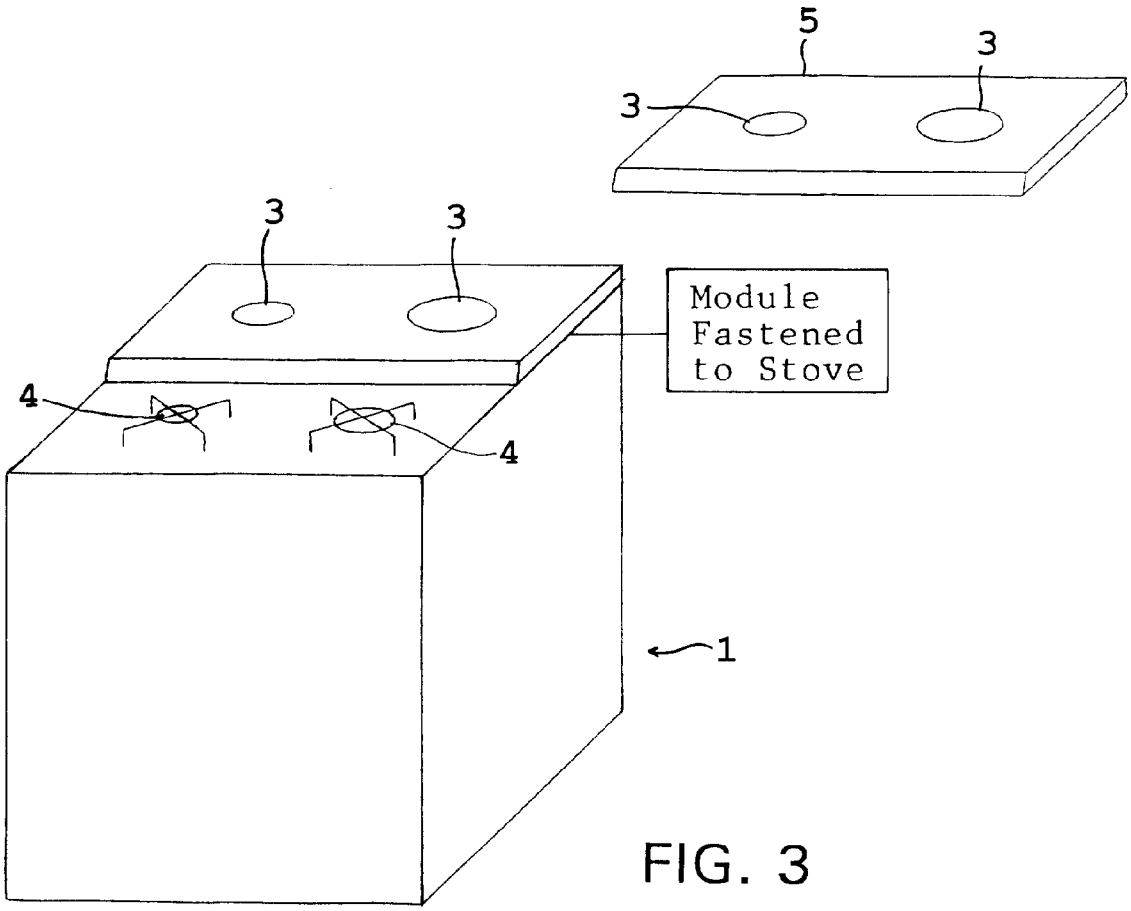
FIG. 3

COOKING UNIT, SUCH AS A STOVE, FOR COOKING FOOD

This is a continuation of U.S. Ser. No. 09/022,466, filed on Feb. 12, 1998, now U.S. Pat. No. 6,021,774.

BACKGROUND OF THE INVENTION

1. Field of the Invention

The present invention relates generally to a unit with at least one plate made of a material which is permeable to thermal radiation, such as glass ceramic, glass, ceramic or a similar material, as a surface for cooking, frying and/or keeping warm. The unit is positioned on a frame construction and has different types of adjustable heat sources distributed underneath and on the plate. Some of the heat sources are distributed under the plate in the form of radiant burners and act indirectly by radiation through the plate. Other heat sources are located above the level of the plate in the form of open atmospheric or atmospheric pressure gas burners and transmit heat directly by producing open flames. The respective heat sources correspond to the cooking, frying and/or warming positions.

2. Background Information

Different heat sources on a cooking unit offer the user altogether different and specific advantages.

For example, the open gas flame of an atmospheric or atmospheric pressure gas burner is very much preferred for rapid browning, frying and sauteing. The atmospheric gas burner is also preferred when extended cooking is not desired.

On the other hand, electrically heated glass ceramic cooktops are prized for the precision with which the heat they produce can be regulated, their uniform temperature distribution and the ability to turn heating circuits on and off with great flexibility. This type of cooktop also includes gas radiant burners which provide heat through the plate indirectly by infrared radiation, as well as known induction cooktops.

A significant number of users could therefore benefit from the characteristics of both types of heat sources. The kitchen cooking appliance industry has responded to this demand by manufacturing combination units.

German Patent No. 30 49 491 C2, describes an oven, the top surface of the oven is formed by a heat transmitting plate, in particular a glass ceramic plate. The heat transmitting plate is formed by a single flat and completely closed surface, below which surface there is at least one gas radiant burner. There is at least one electrical radiant heating element located underneath the heat transmitting plate and outside the cooking area, next to and/or in the slow cooking or warming area.

German Patent No. 30 49 491 C2 describes units with gas radiant burners plus electrically powered radiant heating elements underneath a heat transmitting plate which has a completely closed surface.

French Patent No. 2 626 964 A1 describes an oven in which there is an electrical radiant heating element underneath a glass ceramic cover, as well as standard gas burners with an open flame. French Patent No. 2 626 964 A1 describes different types of heat sources, namely electrical radiant heating elements and open gas burners, whereby in this case the glass ceramic plate covers only the single electrical radiant heating element, and does not form a continuous plate with heat sources distributed underneath and/or on it.

German Patent No. 42 27 672 C2 discloses a cooking unit with a plate made of a material which is permeable to thermal radiation, such as glass ceramic. The cooking unit has different types of heat sources located underneath, in and/or on the plate. Some of the heat sources are infrared gas radiant burners distributed underneath the plate, which infrared gas radiant burners act indirectly through the plate by infrared radiation. Other heat sources are located above and/or at the level of the plate, and transmit heat directly by the generation of open flames in the form of atmospheric open gas burners.

Combination units which have both gas and electrically heated heat sources, are available both as stand-alone ovens and as built-in units.

For example, these types of ovens have a long and successful tradition in France.

In addition to the advantages of the different types of heat generation from the various heat sources, in the past and still to some extent today, the lack of complete security with regard to the supply of either gas or electricity to the heat source also plays a not insignificant role. If the electric power supply fails, for example, cooking can continue with the gas heat source, and conversely, if the gas tank is empty, cooking can continue on the electrically heated cooktop. Such cooking units conventionally consist of four cooking positions, whereby either two of the positions are heated electrically and two of the positions are heated with gas, or three of the positions are heated with gas and one position is heated electrically.

The electrically heated cooking positions, in particular, are covered by a glass ceramic plate, and the actual heating elements are installed underneath the glass ceramic plate.

The electrical heating devices used are radiant heating elements, heater bands, halogen heating elements and also induction heating elements.

Likewise, gas cooking positions can be covered by a glass ceramic plate, underneath which the gas radiant burners are mounted, often with a burner plate made of ceramic or other high-temperature resistant fibers.

Another type of gas cooking position consists of open atmospheric gas burners which are routed through borings in the glass ceramic and sealed in place.

To set the pots on these gas cooking positions, additional top grates, sometimes called pot holders, are necessary. The top grates provide a secure and stable base for the cookware and also guarantee a complete combustion of the gas by admitting a sufficient quantity of air.

In addition to all the advantages of these combined cooking units, however, there is a significant disadvantage, namely that the different working height of the gas cooking positions, which gas cooking positions are operated with open, atmospheric gas burners, which gas burners project above the level of the plate for the surface of the unit, compared to the electric cooking position or the gas cooking position with gas radiant burners, which positions are located underneath the plate, results in pots and pans having to be handled on different levels.

OBJECT OF THE INVENTION

An object of the present invention is to create a cooking unit which is easy and economical to manufacture and can also be retrofitted on existing units.

An additional object of the present invention is to create a cooking unit which compensates for the problem of different working heights of the cooking positions, and whereby the frame constructions which are part of the present invention can be retained from conventional, commercially available units.

SUMMARY OF THE INVENTION

The present invention teaches that these objects can be accomplished in accordance with at least one possible embodiment, on a cooking unit of the type described above with at least one height-equalizing, plate-shaped, modular top part. The modular top part sits on a portion of the frame on which the plate lies, and can be securely fastened to the frame of the unit. The top part also has heat sources which are distributed under its plate and act indirectly by radiation through the plate, so that all the cooking, frying and/or warming positions lie in a plane of substantially equal height. The plane of equal height is defined by the height of the open, atmospheric gas burners located above the level of the plate or by their corresponding pot grates. The plates form two planes parallel to one another and the height of which plates is different.

The objects of the present invention are accomplished in a simple manner by the use of a modular top part for the electrically heated cooking positions. The modular top part, when installed, has a height which corresponds to the height of the top grate, i.e. the grate-like supports placed underneath the pots, of the open gas cooking positions.

A significant advantage of this embodiment is that frame or housing structures of known units can be retained, and the modular top part can be merely inserted and integrated into the existing frame part.

Therefore, the fabrication tools and individual components currently in use can continue to be used, which results in considerable cost advantages. This modular top part also has the advantage that different configurations of cooking units can be realized in a flexible manner. It is possible to fabricate the current model in the conventional manner or, by using the modular top part of the present invention, to manufacture any desired combination unit with cooking positions of the same height.

The present invention teaches that the glass ceramic plate, which glass ceramic plate forms the surface of the unit, can be realized in the form of a single curved piece forming a closed surface, or in the form of two plates, which plates form the levels of different heights and can be joined together in a fluid-tight manner by a simple auxiliary frame. This connection can be made, for example, by means of adhesive joints or suitable frame structures. In one preferred embodiment, the modular top part of the present invention has all the components necessary for its function, such as, displays, controls, current leads and safety devices, so that all that is necessary is to connect the modular top part securely to the unit.

In that embodiment, the top part forms a completely independent, self-contained functional part, which can be securely but detachably connected to the unit.

Alternatively, all the displays and controls can be integrated into the front control panel of the unit itself.

The above discussed embodiments of the present invention will be described further hereinbelow with reference to the accompanying figures. When the word "invention" is used in this specification, the word "invention" includes "inventions", that is, the plural of "invention". By stating "invention", the Applicants do not in any way admit that the present application does not include more than one patentably and non-obviously distinct invention, and maintains that this application may include more than one patentably and non-obviously distinct invention. The Applicants hereby assert that the disclosure of this application may include more than one invention, and, in the event that there is more than one invention, that these inventions may be patentable and non-obvious one with respect to the other.

BRIEF DESCRIPTION OF THE DRAWINGS

The present invention is explained in greater detail below with reference to the exemplary embodiments illustrated in the accompanying drawings, wherein:

FIG. 1 shows a known cooking unit with a glass ceramic plate as a cooking surface having two gas cooking positions and two electric cooking positions, whereby the gas cooking positions are located above the level of the plate, and the electric cooking positions are located on the plate;

FIG. 2 shows a modular top part of the present invention with two electric cooking positions, to be connected by a joint and being particularly well suited for retrofitting in existing units;

FIG. 3 shows a cooking unit with glass ceramic plates as a surface, having two gas cooking positions with open, atmospheric gas burners and a modular top part with two electrical cooking positions which are on the same level as the gas burners or their corresponding top grates.

DESCRIPTION OF THE PREFERRED EMBODIMENT

Figure 4:
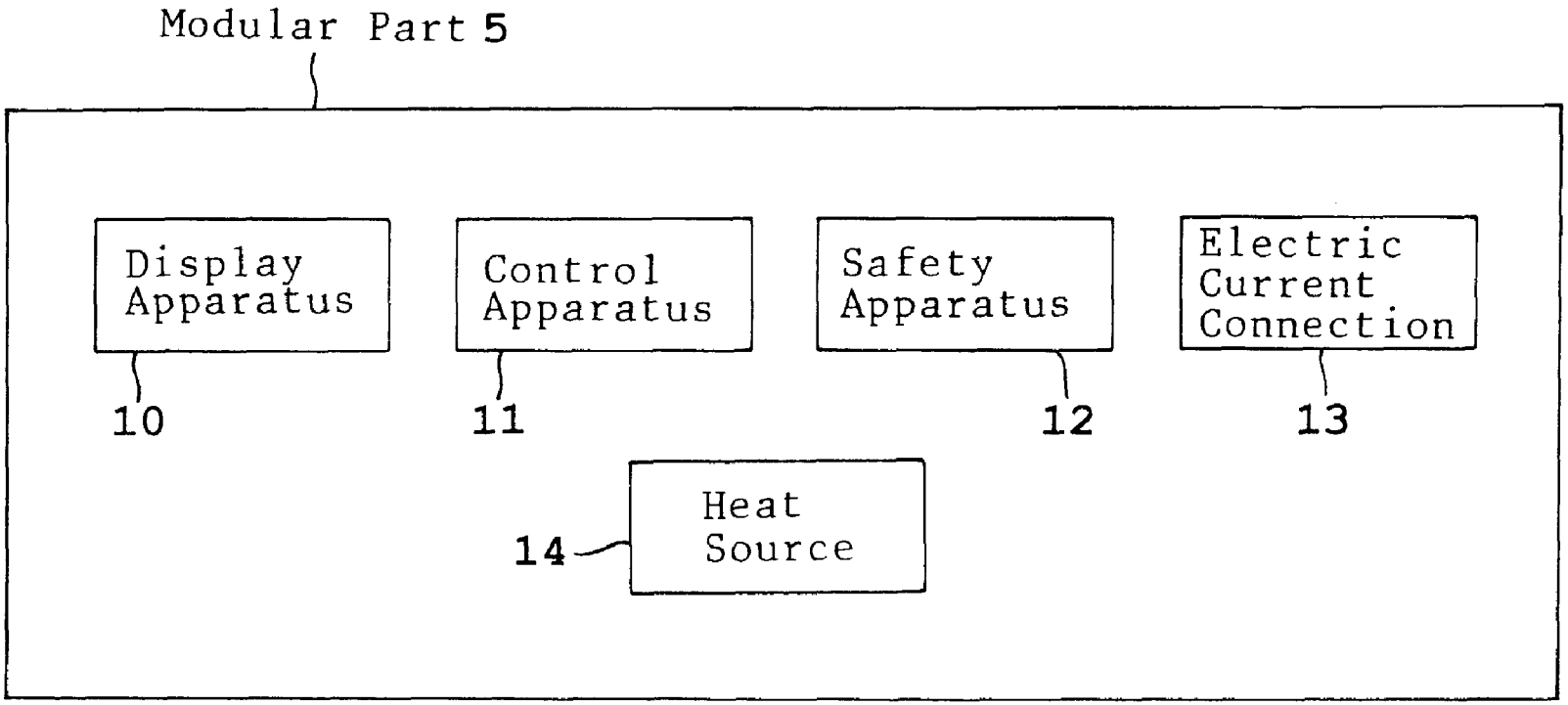
FIG. 4 shows a block diagram of an embodiment of a modular component in accordance with at least one embodiment of the present invention.

FIG. 1 shows, by way of example, a cooking unit 1 with a glass ceramic cooktop 2, with electrically heated cooking zones 3 and gas-heated cooking zones 4. The cooking unit illustrated in FIG. 1 can have a different working height between the electrically heated cooking zone 3 and the gas-heated cooking zone 4. In practical terms, this difference results in the above mentioned disadvantages because pots and pans have to be handled on different levels.

With a modular top part 5 of the present invention as illustrated in FIG. 2, it can become possible in a simple manner to equalize the different heights of the cooking zones. The modular top parts 5 can thereby be integrated into the existing cooking units 1 by the simple auxiliary frame structures. The modular top parts of the present invention can be used in all the frames currently on the market while retaining the existing frame structures of the cooking unit.

In other words and in accordance with one possible embodiment of the present invention, the height of the modular top part 5 can be adjusted at the time of manufacturing to equal the height of the gas burners or other cooking zones in a particular existing frame structure. The modular top part can then be used with many different types and styles of existing frame structures by simply changing the height of the modular top part during the manufacturing process to match the corresponding cooking zones used with the particular frame structure.

The modular top part 5 can thereby be realized with one or two electrical cooking zones 3, as illustrated in FIG. 2. It is possible to integrate these modular top parts by joining the glass ceramic plates by an auxiliary frame, or by the use of a suitably curved glass ceramic plate.

In one exemplary embodiment, the rear electrically heated cooking zones, as illustrated in FIG. 1, have preferably been replaced by the modular top part 5 of the present invention, which modular top part 5 has two electrically heated cooking zones 3, as illustrated in FIG. 3.

Another embodiment results if only one gas-heated cooking zone should be replaced by a modular top part with one electrically heated cooking zone.

FIG. 4 shows a box diagram of one possible embodiment of the present invention, including a modular component 5 with display apparatus 10, control apparatus 11, safety apparatus 12 and an electric current connection 13, as discussed hereinabove. FIG. 4 also shows the modular part 5 with a heat source 14.

Figure 5:
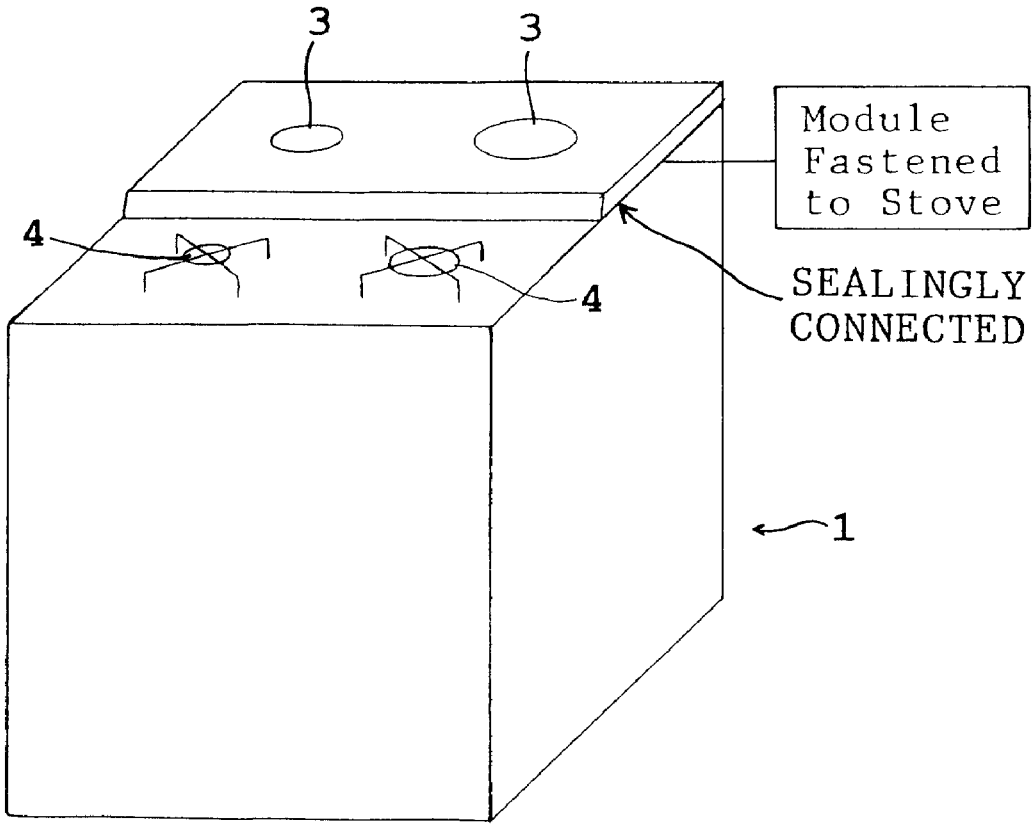
FIG. 5 shows a cooking unit according to at least one embodiment of the present invention.

FIG. 5 shows a cooking unit according to at least one embodiment of the present invention, wherein the frame is configured to sealingly connect the first plate to the second plate.

In one possible embodiment of the present invention, the cooking zones of the modular top part could include several different types of heat sources. Some of these heat sources could include radiant heating elements, induction heating elements or any other similar type of heating element.

In another possible embodiment of the present invention, the modular top part can be attached to the frame construction of the cooking unit by bolts, clips or any other suitable method of attachment.

In another possible embodiment of the present invention, the modular top part can be used with a stove, range or other cooking unit. The stove or cooking unit can also have an oven, a broiler or any other type of similar feature. The stove or cooking unit with the modular top part can be used for the preparation of food and other items in a commercial and/or residential environment.

In yet another possible embodiment of the present invention, the modular top can be used to replace the electrical cooking zones on an existing cooking unit. The old electrical cooking zones can be removed and replaced by the electrical cooking zones in the modular top part. In another embodiment, the electrical cooking zones of the modular top part could also be installed directly over or on top of the old electrical cooking zones.

In still another possible embodiment of the present invention, the modular top can be designed as one piece. The modular top part can have a first region with openings for the gas burners of the gas cooking zones. The modular top part can also have a second region with the electrical cooking zones. A curved region of the modular top part can be used to join the first and second regions of the modular top part so that the height of the electrical cooking zones is substantially equal to the height of the top grates or pot grates of the gas burners in the gas cooking zones. The first region, the second region and the curved region can preferably be realized as one continuous and uninterrupted piece. This one piece modular top part can then be used to quickly and easily replace the plate of an existing stove or cooking unit.

One feature of the invention resides broadly in the cooking unit with at least one plate made of a material which is permeable to thermal radiation, such as glass ceramic, glass, ceramic or a similar material, as a surface for cooking, frying and/or keeping warm, on a frame construction with different types of adjustable heat sources distributed underneath and on the plate, some of which heat sources are distributed under the plate in the form of radiant burners and act indirectly by radiation through the plate, and others of which are located above the level of the plate in the form of open atmospheric or atmospheric pressure gas burners and transmit heat directly by producing open flames, whereby the respective heat sources correspond to the cooking, frying and/or warming positions, characterized by at least one height-equalizing, plate-shaped, modular top part which sits on a portion of the frame on which the plate lies, and can be securely fastened to the frame of the unit, which top part also comprises heat sources which are distributed under its plate and act indirectly by radiation through the plate, so that all the cooking, frying and/or warming positions lie in a plane of equal height, which is defined by the height of the open, atmospheric gas burners located above the level of the plate or by their corresponding pot grates, whereby the plates form two planes parallel to one another and the height of which plates is different.

Another feature of the invention resides broadly in the cooking unit characterized by the fact that the plate which forms the surface of the unit is realized in one piece.

Yet another feature of the invention resides broadly in the cooking unit characterized by the fact that the plates which form the surface of the unit and the height-equalizing planes are joined to one another in a fluid-tight manner by means of an auxiliary frame and are connected to one another.

Still another feature of the invention resides broadly in the cooking unit characterized by the fact that the modular top part contains and comprises all the components necessary for its function.

Some examples of stoves and ranges which may possibly be utilized or adapted for use in the context of the present invention may be disclosed in the following U.S. patents: U.S. Pat. No. 5,213,091, issued on May 25, 1993, to Beach; U.S. Pat. No. D336,210, issued on Jun. 8, 1993, to Birtwisle; U.S. Pat. No. 5,280,152, issued on Jan. 18, 1994, to Lee; U.S. Pat. No. 5,290,997, issued on Mar. 1, 1994, to Lai et al.; U.S. Pat. No. 5,400,765, issued on Mar. 28, 1995, to Goldstein et al.; U.S. Pat. No. D359,345, issued on Jun. 13, 1995, to Schroeter; U.S. Pat. No. D361,015, issued on Aug. 8, 1995, to Doty et al.; and U.S. Pat. No. 5,464,005, issued on Nov. 7, 1995, to Mizrahi.

Some examples of burners and related components which may possibly be utilized or adapted for use in the context of the present invention may be disclosed in the following U.S. patents: U.S. Pat. No. 5,186,158, issued on Feb. 16, 1993, to Ferlin; U.S. Pat. No. D333,943, issued on Mar. 16, 1993, to McWilliams; U.S. Pat. No. 5,323,759, issued on Jun. 28, 1994, to Hammel et al.; U.S. Pat. No. 5,329,918, issued on Jul. 19, 1994, to Di Bari; U.S. Pat. No. 5,397,234, issued on Mar. 14, 1995, to Kwiatek; U.S. Pat. No. 5,397,873, issued on Mar. 14, 1995, to Stoops et al.; and U.S. Pat. No. 5,437,262, issued on Aug. 1, 1995, to George, II et al.

Some examples of related components for stoves and ranges which may possibly be utilized or adapted for use in the context of the present invention may be disclosed in the following U.S. patents: U.S. Pat. No. 5,220,155, issued on Jun. 15, 1993, to Cunningham; U.S. Pat. No. 5,245,159, issued on Sep. 14, 1993, to Chang; U.S. Pat. No. 5,343,020, issued on Aug. 30, 1994, to Waigand et al.; U.S. Pat. No. 5,377,660, issued on Jan. 3, 1995, to Bombardier; U.S. Pat. No. 5,380,985, issued on Jan. 10, 1995, to Graham; and U.S. Pat. No. 5,400,766, issued on Mar. 28, 1995, to Dillon.

Some examples of fastening devices or connecting members which may possibly be utilized or adapted for use in the context of the present invention may be disclosed in the following U.S. patents: U.S. Pat. No. 5,377,392, issued on Jan. 3, 1995, to Morita; U.S. Pat. No. 5,378,029, issued on Jan. 3, 1995, to Hoffeins; U.S. Pat. No. 5,400,501, issued on Mar. 28, 1995, to Marshall; U.S. Pat. No. 5,404,775, issued on Apr. 11, 1995, to Abe; U.S. Pat. No. 5,407,364, issued on Apr. 18, 1995, to Tzeng et al.; U.S. Pat. No. 5,429,333, issued on Jul. 4, 1995, to Klein; U.S. Pat. No. D360,568, issued on Jul. 25, 1995, to Fukuhara et al.; and U.S. Pat. No. 5,456,406, issued on Oct. 10, 1995, to Lemelson.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 197 05 715.2-16, filed on Feb. 14, 1997, having inventors Martin Taplan, Herwig Scheidler, and Christof Köster, and DE-OS 197 05 715.2-16 and DE-PS 197 05 715.2-16, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A stove for cooking food, said stove comprising:

a stove body;

at least one open atmospheric gas burner;

said at least one open atmospheric gas burner being disposed on said stove body;

said at least one open atmospheric gas burner comprising a first cooking plane to receive a bottom of a cooking utensil;

a planar area being disposed about said at least one open atmospheric gas burner;

said stove body comprising at least one part;

said at least one part having a height;

said at least one part comprising:

a second cooking plane to receive a bottom of a cooking utensil; and at least one non-gas burner;

said at least one non-gas burner being disposed adjacent said second cooking plane;

said at least one heat non-gas burner being configured to act through said second cooking plane;

said height of said at least one part disposing said second cooking plane of said at least one part at a greater height than said planar area disposed about said at least one atmospheric gas burner; and said first cooking plane and said second cooking plane having a substantially equal height to permit movement of a cooking utensil between said first cooking plane and said second cooking plane without any substantial change in height of the cooking utensil.

2. The stove according to claim 1, wherein:

said stove body comprises at least one first plate;

said at least one first plate is disposed on a portion of said stove body;

said at least one first plate is disposed about said at least one open atmospheric gas burner;

said planar area is disposed on said at least one first plate;

said at least one part is disposed on said portion of said stove body;

said at least one part is securely fastened to said stove body;

said at least one part comprises a second plate;

said second cooking plane being disposed on said second plate; and said at least one first plate and said second plate are disposed substantially parallel to one another.

3. The stove according to claim 2, wherein said at least one first plate comprises a single piece.

4. The stove according to claim 3, wherein said at least one modular part comprises a display apparatus.

5. The stove according to claim 4, wherein:

said at least one open atmospheric gas burner is configured to transmit heat directly by producing open flames;

said at least one open atmospheric gas burner is disposed above said at least one first plate;

said at least one open atmospheric gas burner comprises a pot grate;

said first cooking plane is disposed on said pot grate;

said at least one first plate comprises a material permeable to thermal radiation as a plane for at least one of cooking, frying and keeping warm; and said material permeable to thermal radiation consisting of one of glass ceramic, glass and ceramic.

6. The stove according to claim 2, wherein said at least one first plate is connected to said second plate.

7. The stove according to claim 6, further comprising:

a frame structure; and said frame structure is configured and disposed to sealingly connect said at least one first plate and said second plate to limit the leakage of fluids between said at least one first plate and said second plate.

8. The stove according to claim 7, wherein:

said at least one first plate and said second plate comprise a material permeable to thermal radiation as a plane for at least one of cooking, frying and keeping warm; and said material permeable to thermal radiation consisting of one of glass ceramic, glass and ceramic.

9. The stove according to claim 8, wherein:

said at least one adjustable-height, plate-shaped, modular top part is detachably connected to said stove;

said at least one open atmospheric gas burner comprises a pot grate; and said first cooking plane is disposed on said pot grate.

10. The stove according to claim 6, wherein said at least one first plate and said second plate are configured to form one piece.

11. The stove according to claim 10, wherein:

said at least one open atmospheric gas burner is configured to transmit heat directly by producing open flames;

said at least one open atmospheric gas burner is disposed above said at least one first plate;

said at least one open atmospheric gas burner comprises a pot grate;

said first cooking surface is disposed on said pot grate;

said at least one first plate and said second plate both comprise a material permeable to thermal radiation as a surface for at least one of cooking, frying and keeping warm; and said material permeable to thermal radiation consisting of one of glass ceramic, glass and ceramic.

12. A kit to adapt a stove to a stove with different cooking planes at a substantially uniform cooking height, said stove comprising a stove body, at least one open atmospheric gas burner, the at least one open atmospheric gas burner being disposed on the stove body, the at least one open atmospheric gas burner comprising a first cooking plane to receive a bottom of a cooking utensil, and a planar area being disposed about the at least one open atmospheric gas burner, said kit comprising:

at least one part;

said at least one part being configured to be disposed on the stove body;

said at least one part having a height;

said at least one part comprising:

a second cooking plane being configured to receive a bottom of a cooking utensil; and at least one non-gas burner;

said at least one non-gas burner being disposed under said second cooking plane;

said at least one non-gas burner being configured to act through said second cooking plane;

said height of said at least one part being configured to dispose said second cooking plane of said at least one part at a greater height than the planar area disposed about the at least one atmospheric gas burner; and said second cooking plane being configured to have a height substantially equal to the height of the first cooking plane to permit movement of a cooking utensil between the first cooking plane and said second cooking plane without any substantial change in height of the cooking utensil.

13. The kit to adapt a stove according to claim 12, wherein the stove body comprises at least one first plate, the at least one first plate is disposed on a portion of the stove body, the at least one first plate is disposed about the at least one open atmospheric gas burner, and the planar area is disposed on the at least one first plate, wherein:

said at least one part is configured to be disposed on the portion of said stove body;

said at least one part is configured to be securely fastened to the stove body;

said at least one part comprises a second plate;

said second cooking plane being disposed on said second plate; and said second plate is configured to be disposed substantially parallel to the at least one first plate.

14. The kit to adapt a stove according to claim 13, wherein the at least one first plate is connected to said second plate, the stove comprises a frame structure, and said frame structure is configured and disposed to sealingly connect said at least one first plate and said second plate to limit the leakage of fluids between said at least one first plate and said second plate, and wherein said at least one part comprises a display apparatus.

15. A cooking unit comprising:

a body;

at least one open atmospheric gas burner;

said at least one open atmospheric gas burner being disposed on said body;

said at least one open atmospheric gas burner comprising a first cooking plane to receive a bottom of a cooking utensil;

a planar area being disposed about said at least one open atmospheric gas burner;

said body comprising at least one part;

said at least one part having a height;

said at least one part comprising:

a second cooking plane to receive a bottom of a cooking utensil; and at least one non-gas burner;

said at least one non-gas burner being disposed under said second cooking plane;

said at least one non-gas burner being configured to act through said second cooking plane;

said height of said at least one part disposing said second cooking plane of said at least one part at a greater height than said planar area disposed about said at least one atmospheric gas burner; and said first cooking plane and said second cooking plane having a substantially equal height to permit movement of a cooking utensil between said first cooking plane and said second cooking plane without any substantial change in height of the cooking utensil.

16. The cooking unit according to claim 15, wherein:

said body comprises at least one first plate;

said at least one first plate comprises one first plate;

said one first plate is disposed on a portion of said body;

said one first plate is disposed about said at least one open atmospheric gas burner;

said planar area is disposed on said one first plate;

said at least one part is disposed on said portion of said body;

said at least one part is securely fastened to said body;

said at least one part comprises a second plate;

said second cooking surface being disposed on said second plate;

said one first plate and said second plate are disposed substantially parallel to one another;

said at least one open atmospheric gas burner is configured to transmit heat directly by producing open flames;

said at least one open atmospheric gas burner is disposed above said one first plate;

said at least one open atmospheric gas burner comprises a pot grate;

said first cooking plane is disposed on said pot grate;

said one first plate comprises a material permeable to thermal radiation as a plane for at least one of cooking, frying and keeping warm; and said material permeable to thermal radiation consisting of one of glass ceramic, glass and ceramic.

17. The cooking unit according to claim 15, further comprises:

said body comprises at least one first plate;

said at least one first plate is disposed on a portion of said body;

said at least one first plate is disposed about said at least one open atmospheric gas burner;

said planar area is disposed on said at least one first plate;

said at least one part is disposed on said portion of said body;

said at least one part is securely fastened to said body;

said at least one part comprises a second plate;

said second cooking plane being disposed on said second plate;

said at least one first plate and said second plate are disposed substantially parallel to one another;

said at least one first plate is connected to said second plate;

a frame structure;

said frame structure is configured and disposed to sealingly connect said at least one first plate and said second plate to limit the leakage of fluids between said at least one first plate and said second plate;

at least one radiant burner;

said at least one radiant burner is disposed under said at least one first plate;

said at least one radiant burner is configured to act indirectly by radiation through said at least one first plate;

said at least one first plate comprises a material permeable to thermal radiation as a plane for at least one of cooking, frying and keeping warm;

said material permeable to thermal radiation consisting of one of glass ceramic, glass and ceramic;

said at least one open atmospheric gas burner and said at least one radiant burner correspond to cooking, frying and warming positions;

said at least one open atmospheric gas burner comprises a pot grate; and said first cooking plane is disposed on said pot grate.

18. The cooking unit according to claim 15, wherein:

said body comprises at least one first plate;

said at least one first plate is disposed on a portion of said body;

said at least one first plate is disposed about said at least one open atmospheric gas burner;

said planar area is disposed on said at least one first plate;

said at least one part is disposed on said portion of said body;

said at least one part is securely fastened to said body;

said at least one part comprises a second plate;

said second cooking plane being disposed on said second plate;

said at least one first plate and said second plate are disposed substantially parallel to one another;

said at least one open atmospheric gas burner comprises a pot grate;

said first cooking plane is disposed on said pot grate;

said at least one first plate and said second plate comprise a material permeable to thermal radiation as a plane for at least one of cooking, frying and keeping warm; and said material permeable to thermal radiation consisting of one glass ceramic, glass and ceramic.

* * * * *